US010615521B2

(12) United States Patent
Miyazaki et al.

(10) Patent No.: US 10,615,521 B2
(45) Date of Patent: Apr. 7, 2020

(54) COAXIAL CABLE CONNECTOR PROVIDED WITH A HOUSING HAVING A PAIR OF CRIMPING PIECES

(71) Applicant: Hirose Electric Co., Ltd., Shinagawa-ku, Tokyo (JP)

(72) Inventors: Atsuhiro Miyazaki, Tokyo (JP); Yujin Haga, Tokyo (JP)

(73) Assignee: HIROSE ELECTRIC CO., LTD, Tokyo (JP)

( * ) Notice: Subject to any disclaimer, the term of this patent is extended or adjusted under 35 U.S.C. 154(b) by 0 days.

(21) Appl. No.: 16/276,496

(22) Filed: Feb. 14, 2019

(65) Prior Publication Data

US 2019/0296459 A1 Sep. 26, 2019

(30) Foreign Application Priority Data

Mar. 23, 2018 (JP) ..... 2018-056572

(51) Int. Cl.
*H01R 9/05* (2006.01)
*H01R 13/506* (2006.01)
(Continued)

(52) U.S. Cl.
CPC ..... *H01R 9/0518* (2013.01); *H01R 13/42* (2013.01); *H01R 13/506* (2013.01); *H01R 24/50* (2013.01)

(58) Field of Classification Search
CPC .... H01R 9/0518; H01R 13/42; H01R 13/506; H01R 24/38; H01R 24/50; H01R 4/01; H01R 4/18; H01R 4/183–185
See application file for complete search history.

(56) References Cited

U.S. PATENT DOCUMENTS 2,142,818 A * 1/1939 Jacobson ..... H01R 4/185 439/865
3,404,368 A * 10/1968 Roberts ..... H01R 4/2495 439/866

(Continued)

FOREIGN PATENT DOCUMENTS

JP 2016-110709 A 6/2016
JP 2018-006012 A 1/2018

OTHER PUBLICATIONS

English translation of JP-2016110709-A (Year: 2016).*

*Primary Examiner* — Oscar C Jimenez
(74) *Attorney, Agent, or Firm* — Procopio, Cory, Hargreaves & Savitch LLP

(57) ABSTRACT

The connector is provided with a terminal and a housing supporting the terminal. A portion of the terminal is exposed through the housing to form a mounting surface, and the housing has a pair of crimping pieces provided on opposite sides sandwiching the mounting surface so as to permit pivoting toward the mounting surface about fold lines. The pair of crimping pieces include, respectively, opposed faces facing the mounting surface and abutting faces brought into abutment against a counterpart crimping piece. A recessed portion that engages with a convex portion provided on the abutting face of a counterpart crimping piece when the pair of crimping pieces are pivoted is provided on one abutting face of the pair of crimping pieces. A covering portion that covers the engagement portion of the recessed and convex portions is provided on the side of the recessed portion opposite to the opposed faces.

8 Claims, 10 Drawing Sheets

(51) Int. Cl.
*H01R 24/50* (2011.01)
*H01R 13/42* (2006.01)

(56) References Cited

U.S. PATENT DOCUMENTS

| | | | | |
|---|---|---|---|---|
| 5,338,233 | A * | 8/1994 | Endo | H01R 4/185 439/865 |
| 10,199,780 | B2 * | 2/2019 | Volkmann | H01R 4/184 |
| 2006/0089046 | A1 * | 4/2006 | Annequin | H01R 43/048 439/578 |
| 2006/0246777 | A1 * | 11/2006 | Wang | H01R 9/0518 439/582 |

* cited by examiner

COAXIAL CABLE CONNECTOR PROVIDED WITH A HOUSING HAVING A PAIR OF CRIMPING PIECES

CROSS REFERENCE TO RELATED APPLICATIONS

This Paris Convention Patent Application claims benefit under 35 U.S.C. § 119 and claims priority to Japanese Patent Application No. JP 2018-056572, filed on Mar. 23, 2018, titled "COAXIAL CABLE CONNECTOR PROVIDED WITH A HOUSING HAVING A PAIR OF CRIMPING PIECES", the content of which is incorporated herein in its entirety by reference for all purposes.

BACKGROUND

Technical Field

The present invention relates to a coaxial cable connector, in particular, to a coaxial cable connector provided with a housing having a pair of crimping pieces.

Background Art

An exemplary prior-art coaxial cable connector is illustrated in Japanese Patent Application Publication No. 2016-110709 (Patent Document 1). This coaxial cable connector is essentially provided with a terminal, a housing supporting the terminal, and an outer conductor shell covering at least a portion of the housing. A portion of the terminal is exposed through the housing as a contact portion to be brought in contact with a terminal in a counterpart coaxial cable and, in addition, as a mounting surface on which the core wire of the coaxial cable is mounted. The housing has a pair of crimping pieces provided on opposite sides sandwiching the mounting surface so as to permit pivoting toward the mounting surface about fold lines. Pivoting the crimping pieces toward the mounting surface allows for the core wire of the coaxial cable mounted on the mounting surface to be crimp-connected to the mounting surface. A crimp connection can be accomplished, for example, by swaging a portion of the outer conductor shell and causing the crimping pieces to pivot through the abutment against said portion.

In addition to opposed faces, which are positioned opposite the mounting surface when the pair of crimping pieces are pivoted, the crimping pieces have abutting faces that are brought into abutment against a counterpart crimping piece. On each of these abutting faces, there are provided recessed and convex portions complementary to recessed and convex portions on a counterpart crimping piece, and engaging these paired recessed and convex portions allows for connecting, holding, and securing the core wire of the coaxial cable to the terminal without protrusion beyond the crimping pieces.

PRIOR ART LITERATURE

Patent Documents

[Patent Document 1] Japanese Patent Application Publication No. 2016-110709. [Patent Document 2] Japanese Patent Application Publication No. 2018-006012.

SUMMARY

Problems to be Solved

The configuration of Patent Document 1 makes it possible to easily and reliably connect, hold, and secure the core wire of the coaxial cable to the terminal. However, a portion of the core wire is likely to protrude from the engagement portion of the recessed and convex portions when the paired recessed and convex portions provided on the crimping pieces are engaged. As described in Japanese Patent Application Publication No. 2018-006012 (Patent Document 2), in order to prevent protrusion in a more reliable manner, a covering portion that covers the engagement portion are provided on the side of the recessed portion opposite to the opposed faces. However, if such a covering portion is provided, there is a risk that the covering portion may collide with the convex portion when the recessed and convex portions are engaged.

The invention of the present Application, which was made in order to eliminate the above-described problems of the prior art, relates to a cable connector provided with a housing having a pair of crimping pieces including recessed and convex portions on faces abutting against counterpart crimping pieces, and it is an object of the invention to provide a cable connector which, in a configuration provided with a covering portion used to prevent cable (core wire) protrusion, is capable of preventing the covering portion from colliding with the convex portion.

Solution to the Problems

The inventive cable connector is characterized by the fact that the connector is provided with a terminal, a housing supporting the terminal, and an outer conductor shell covering the at least a portion of the housing; a portion of the terminal is exposed through the housing to form a mounting surface; the housing has a pair of crimping pieces provided on opposite sides sandwiching the mounting surface so as to permit pivoting toward the mounting surface about fold lines; the pair of crimping pieces include, respectively, opposed faces that are positioned opposite the mounting surface when the pair of crimping pieces are pivoted, and abutting faces brought into abutment against counterpart crimping pieces; at least one of the abutting faces of the pair of crimping pieces is provided with a recessed portion that engages with a convex portion provided on the abutting faces of the counterpart crimping pieces when the pair of crimping pieces are pivoted; a covering portion that covers the engagement portion of the recessed and convex portions is provided on the side of the recessed portion opposite to the opposed faces; and the covering portion is provided with a relief space that prevents collision with the convex portion when the pair of crimping pieces are pivoted and the recessed portion engages with the convex portion.

If a covering portion is provided in order to prevent core wire protrusion, this configuration makes it possible to provide a cable connector capable of preventing collision of the covering portion with the convex portion.

In the cable connector of the above-described configuration, the relief space, when viewed in the direction of the fold lines, may be formed as a tapered surface that extends from the abutting face in the covering portion to the abutting face in the recessed portion, or may be formed as a stepped surface that extends from the abutting face in the covering portion to the abutting face in the recessed portion.

In the cable connector of the above-described configuration, the opposed faces may form surfaces at locations spaced apart from the mounting surface when the opposed faces are positioned opposite the mounting surface.

This configuration makes it possible to reliably secure the core wire even if the core wire is thick.

In the cable connector of the above-described configuration, at least a total of 3 convex and recessed portions may be arranged on the abutting faces of the pair of crimping pieces in an alternating manner in the direction of the fold lines.

In the cable connector of the above-described configuration, protruding portions protruding toward the mounting surface may be provided on the opposed faces in a direction intersecting with the fold lines.

In addition, in the cable connector of the above-described configuration, protruding portions protruding toward the opposed faces may be provided on the mounting surface in a direction intersecting with the fold lines.

Furthermore, the protruding portions of the opposed faces and the protruding portions of the mounting surface may be provided in an alternating manner in the direction of the fold lines.

This configuration makes it possible to reliably secure the core wire.

The cable connector of the above-described configuration may be a coaxial cable connector further provided with an outer conductor shell covering at least a portion of the housing.

Technical Effect

It is an object of the present invention to provide a cable connector which, in the event of providing a covering portion in order to prevent cable protrusion, is capable of preventing collision of the covering portion and a convex portion. The present invention, which relates to a cable connector provided with a housing having a pair of crimping pieces including recessed and convex portions on faces abutting against counterpart crimping pieces, provides a cable connector which, in a configuration provided with a covering portion preventing cable (core wire) protrusion, is capable of preventing collision of the covering portion and the convex portion.

DETAILED DESCRIPTION

A preferred embodiment of the present invention will be described with reference to the accompanying drawings. While the discussion below refers to so-called right-angle coaxial connectors, the present invention is not limited to that context and, for example, is also applicable to cable connectors of the vertical type.

Figure 1:
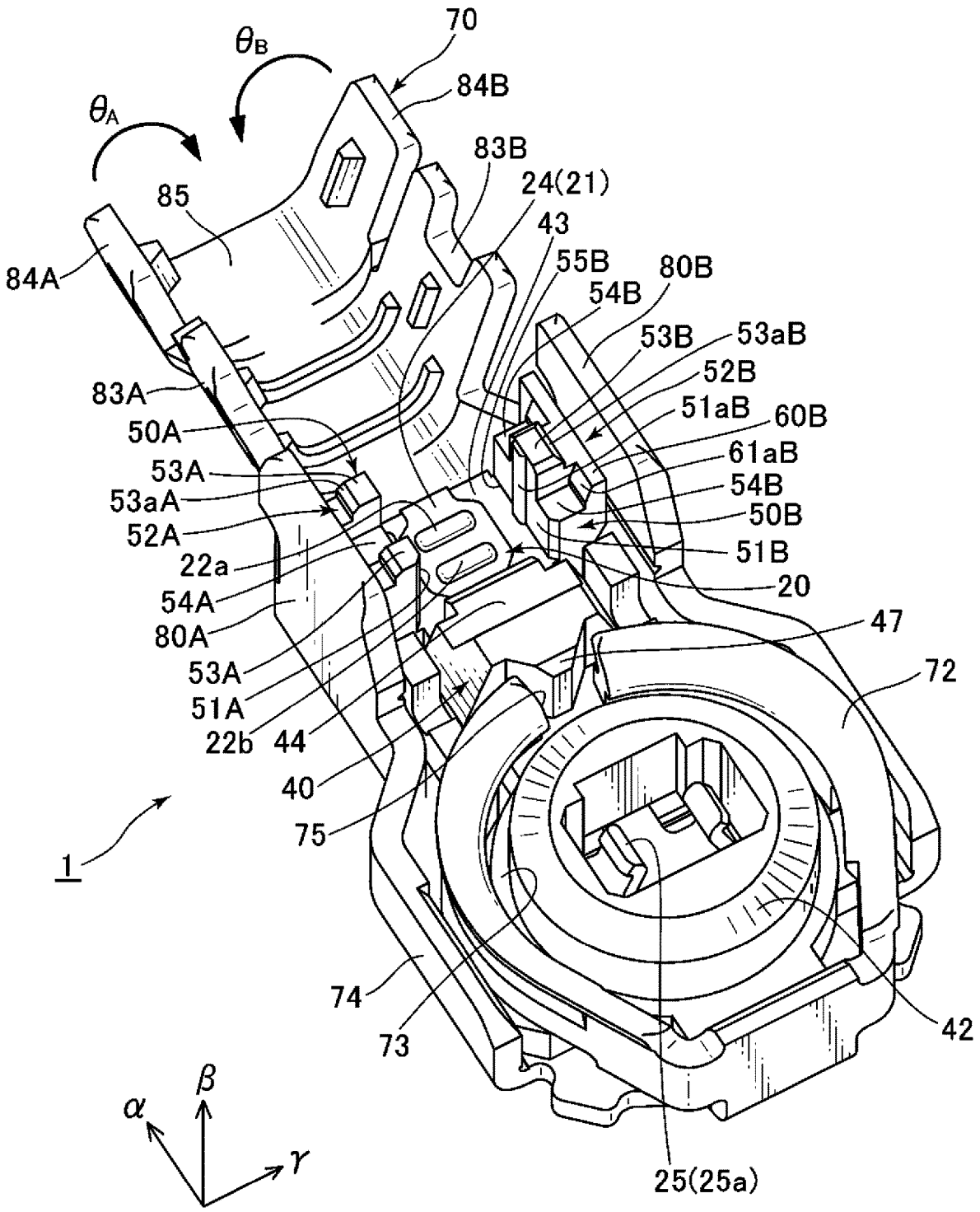
FIG. 1 A perspective view of the coaxial cable connector according to the present invention.
Figure 2:
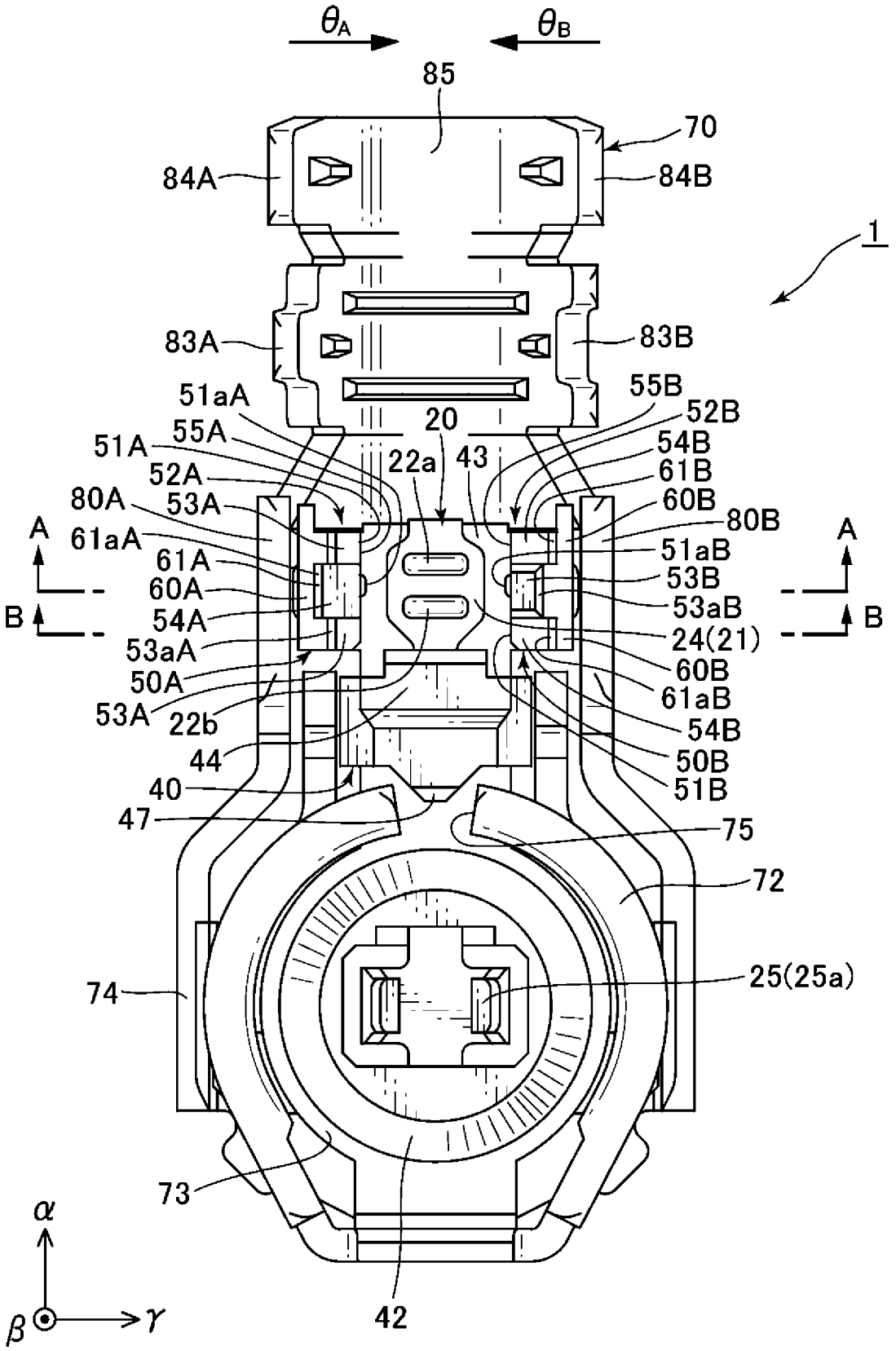
FIG. 2 A perspective view of the coaxial cable connector of FIG. 1 as viewed from a different angle.
Figure 3:
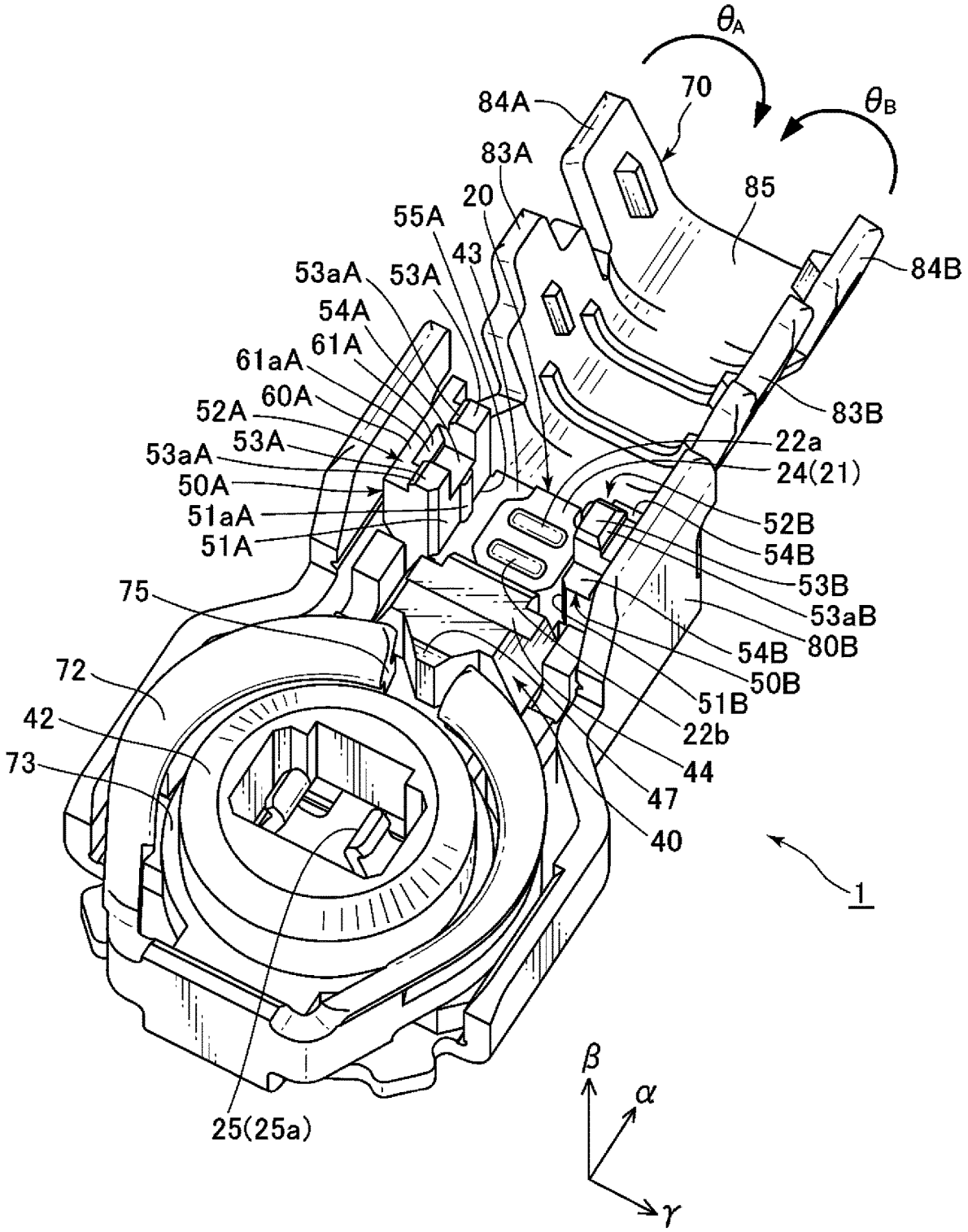
FIG. 3 A perspective view of the coaxial cable connector of FIG. 1 as viewed from a different angle.
Figure 4:
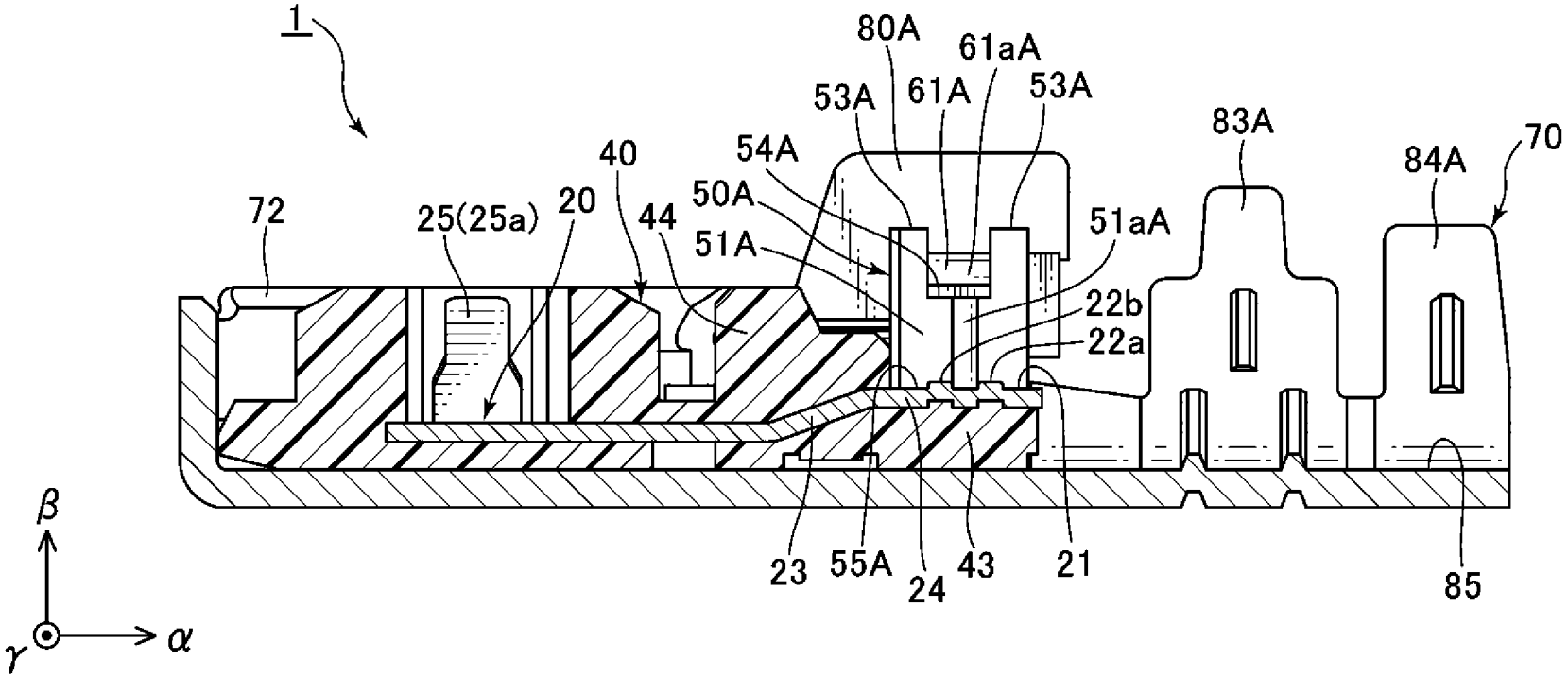
FIG. 4 A midline section view of the coaxial cable connector illustrated in FIGS. 1 to 3.
Figure 5:
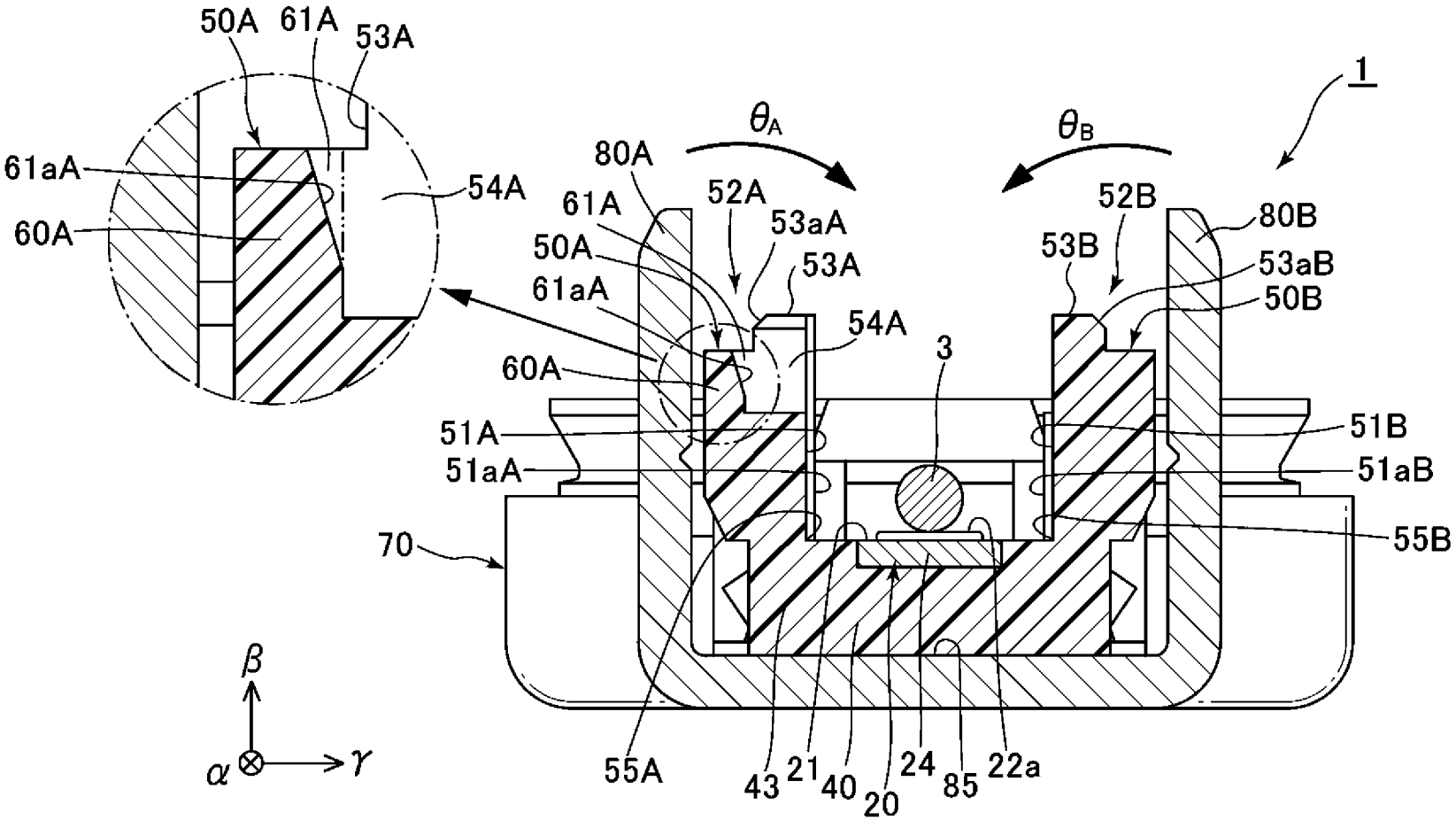
FIG. 5 A cross-sectional view taken along line A-A in FIG. 2.
Figure 6:
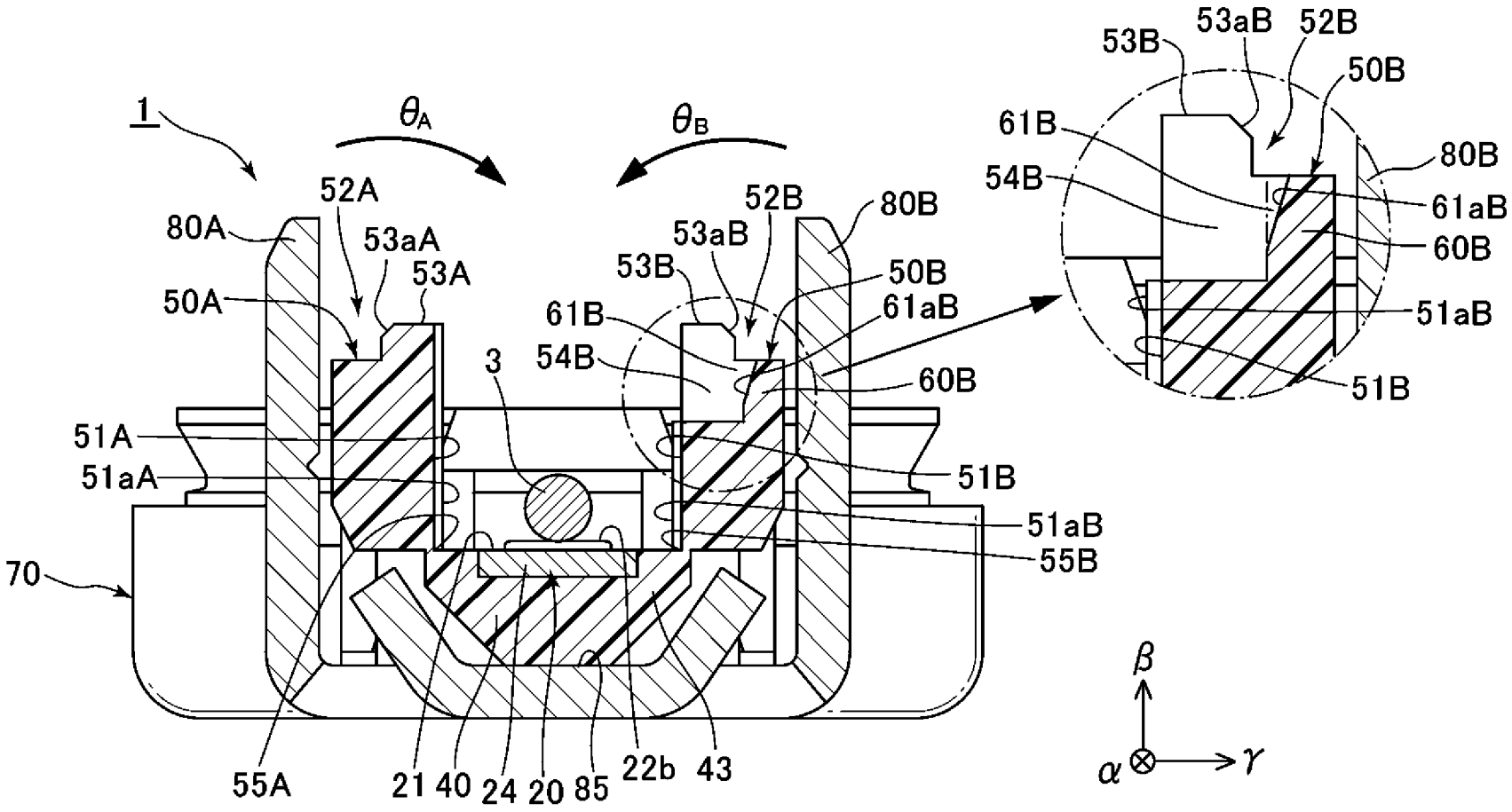
FIG. 6 A cross-sectional view taken along line B-B in FIG. 2.

FIG. 1 is a perspective view of the inventive coaxial cable connector 1, FIG. 2 and FIG. 3 are perspective views of the coaxial cable connector of FIG. 1 as viewed from a different angle, FIG. 4 is a midline section view of the coaxial cable connector illustrated in FIG. 1 through FIG. 3, FIG. 5 is a cross-sectional view taken along line A-A in FIG. 2, and FIG. 6 is a cross-sectional view taken along line B-B in FIG. 2.

The coaxial cable connector 1, whose shape is bilaterally symmetrical about an axial centerline, is essentially provided with a conductive terminal 20, an insulative housing 40 supporting the terminal 20, and an outer conductor shell 70 covering at least a portion of the housing 40 and the coaxial cable (not shown in the drawing).

The terminal 20 has a predetermined length in the axial direction "a" of the coaxial cable secured to the coaxial cable connector 1. The coaxial cable has the same construction as an ordinary conventional coaxial cable, in other words, in the direction from the outermost shell to the center, it is provided with an insulating jacket, an outer conductor, insulation, and a core wire. A detailed description is omitted here because this structure is well-known. A contact portion 25 that is brought in contact with a center terminal in a counterpart coaxial connector is provided at the distal end of the terminal 20. A portion 25*a* of the contact portion 25 is raised toward the side of contact with the counterpart connector and is formed as a pair of resilient strips that allow for the center terminal of the counterpart connector to be inserted in the center. A connecting portion 24 that is brought in contact with the core wire of the coaxial cable is provided at the rear end of the terminal 20. A mounting surface 21 that is connected to the core wire of the coaxial cable can be formed on the surface of the connecting portion 24. A stepped portion 23 (see FIG. 4) is provided between the contact portion 25 and the connecting portion 24. In the integrally molded housing 40, this stepped portion 23 is adapted to bring the rear end (24) of the terminal 20 closer to the coaxial cable than the front end (25), and, on the other hand, is intended to bring the front end (25) of the terminal 20 closer to the placement surface 85 of the outer conductor shell 70 than the rear end (24).

The outer conductor shell 70 is formed by punching and bending a piece of sheet metal. The outer conductor shell 70 essentially includes a placement surface 85 on which the housing 40 and coaxial cable are mounted, a cylindrical mating portion 72 provided at the distal end of this placement surface 85, and, furthermore, multiple pieces, i.e., enclosing pieces 80A, 80B, outer conductor crimping pieces 83A, 83B, and jacket crimping pieces 84A, 84B. Here, the letters "A" and "B" indicate the right and left sides (same hereafter). The mating portion 72 is a section connected to a cylindrical shell (not shown in the drawing) in the counterpart connector during mating with the counterpart connector. The cylindrical shell of the counterpart connector is inserted into a gap 73 formed between the mating portion 72 of the outer conductor shell 70 and the mating portion 42 of the housing 40. The distal end of the placement surface 85, which is generally in the shape of a scoop, is constructed such that the mating portion 72 is surrounded by a raised portion 74, which is a portion forming a bowl portion, thereby enhancing the strength of the mating portion 72.

The enclosing pieces 80A, 80B, the outer conductor crimping pieces 83A, 83B, and the jacket crimping pieces 84A, 84B are arranged in the axial direction "a" of the coaxial cable. In addition, these pieces are formed in pairs, with each pair disposed such that its sides face and sandwich the placement surface 85. The front enclosing pieces 80A, 80B are intended mainly for securing the core wire of the coaxial cable by swaging the pair of crimping pieces 50A, 50B, the outer conductor crimping pieces 83A, 83B are intended mainly for swaging the outer conductor of the coaxial cable, and the jacket crimping pieces 84A, 84B are intended mainly for swaging the insulating jacket of the coaxial cable. As described hereafter, when the coaxial cable is installed in the outer conductor shell 70, the core wire of the coaxial cable is mounted to the mounting surface 21 of the terminal 20 and, at the same time, the outer conductor of the coaxial cable is mounted to the placement surface 85 at locations corresponding to the outer conductor crimping pieces 83A, 83B and, in addition, the insulating jacket of the coaxial cable is mounted to the placement surface 85 at locations corresponding to the jacket crimping pieces 84A, 84B and swaged at the respective locations with the help of swaging portions.

The housing 40 is essentially provided with a main body portion 44, a cylindrical mating portion 42 provided at the distal end of the main body portion 44, a mounting portion 43 provided at the rear end of the main body portion 44, and, additionally, a pair of crimping pieces 50A, 50B. Each of these components is molded integrally with the terminal 20 using a plastic molding process. However, even after integral molding, a portion of the terminal 20, for example, at least a portion of the contact portion 25 (resilient strips 25*a*, etc.), and at least a portion of the connecting portion 24 (mounting surface 21) remain exposed to the outside environment.

Overall, the main body portion 44 is substantially cubic in shape. A section of the main body portion 44 forms a protruding portion 47 protruding toward the mating portion 42 in the axial direction "α" of the coaxial cable. The protruding portion 47 is a section that is complementary to a non-continuous section 75 of the mating portion 72 of the outer conductor shell 70.

The mating portion 42 is a section protruding toward the side of contact with the counterpart connector and has the contact portion 25 of the terminal 20 disposed in its center. During mating with the counterpart coaxial connector, the mating portion 42 is inserted into the cylindrical shell of the counterpart coaxial connector and, at the same time, the center terminal disposed in the center of the cylindrical shell is inserted into and brought in contact with the contact portion 25 disposed in the center of the mating portion 42.

In the mounting portion 43, the connecting portion 24 of the terminal 20 is embedded in the housing 40 while leaving the mounting surface 21 exposed. The core wire of the coaxial cable, which is to be crimped, is mounted to the mounting surface 21.

The crimping pieces 50A, 50B are provided on opposite sides sandwiching the mounting surface 21 so as to permit pivoting, respectively, about the fold lines 55A, 55B extending along the axial direction "α" of the coaxial cable toward the mounting surface 21, in other words, in the directions "$\theta_A$" and "$\theta_B$" shown in the drawing. It should be noted that FIGS. 1 through 6 illustrate a state prior to the pivoting of the pair of crimping pieces 50A, 50B. These crimping pieces 50A, 50B include, respectively, opposed faces 51A, 51B facing the mounting surface 21 when the pair of crimping pieces 50A, 50B are pivoted (surfaces formed in the directions "α" and "β" in FIGS. 1 to 6 prior to the pivoting of the pair of crimping pieces 50A, 50B) and abutting faces 52A, 52B brought into abutment against the counterpart crimping pieces when the pair of crimping pieces 50A, 50B are similarly pivoted (surfaces formed in the directions "α" and "γ" in FIGS. 1 to 6 prior to the pivoting of the pair of crimping pieces 50A, 50B).

Protruding portions 51*a*A, 51*a*B, which respectively protrude toward the mounting surface 21, are provided on the opposed faces 51A, 51B in the direction "β (or γ)" intersecting with the fold lines 55A, 55B. As a result of providing the protruding portions 51*a*A, 51*a*B, the pushing force of the opposed faces 51A, 51B applied to the mounting surface 21 can be enhanced in the section where these protruding portions 51*a*A, 51*a*B are provided.

Similarly, protruding portions 22*a*, 22*b*, which protrude toward the opposed faces 51A, 51B, are provided on the mounting surface 21 in the direction "β (or γ)" intersecting with the fold lines 55A, 55B. As a result of providing the protruding portions 22*a*, 22*b*, the pushing force of the mounting surface 21 applied to the opposed faces 51A, 51B can be enhanced in the section where these protruding portions 51*a*A, 51*a*B are provided.

Figure 7:
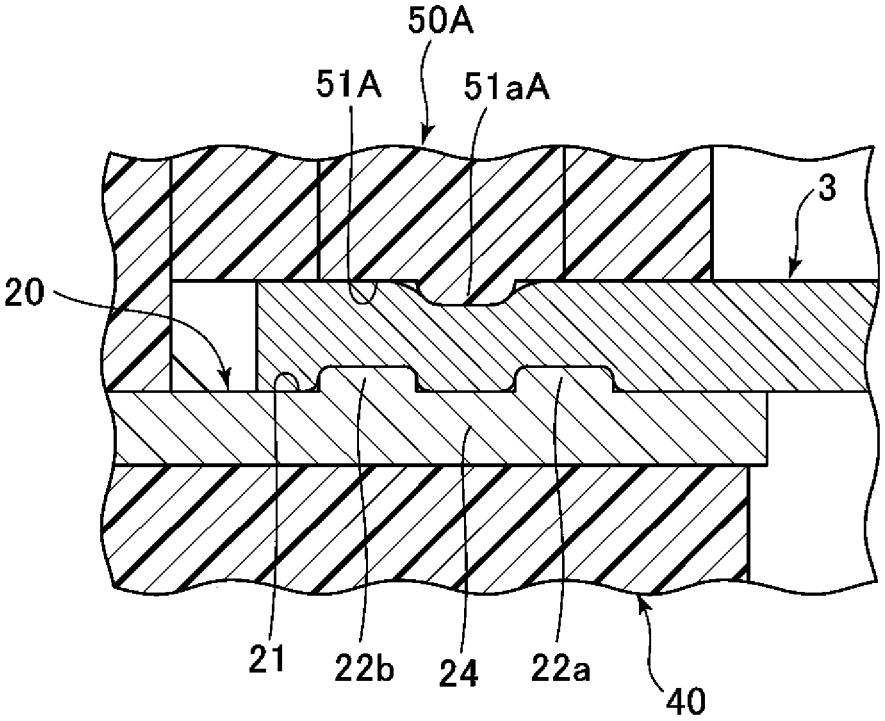
FIG. 7 A cross-sectional view illustrating a state in which the protruding portions are engaged.
Figure 8A:
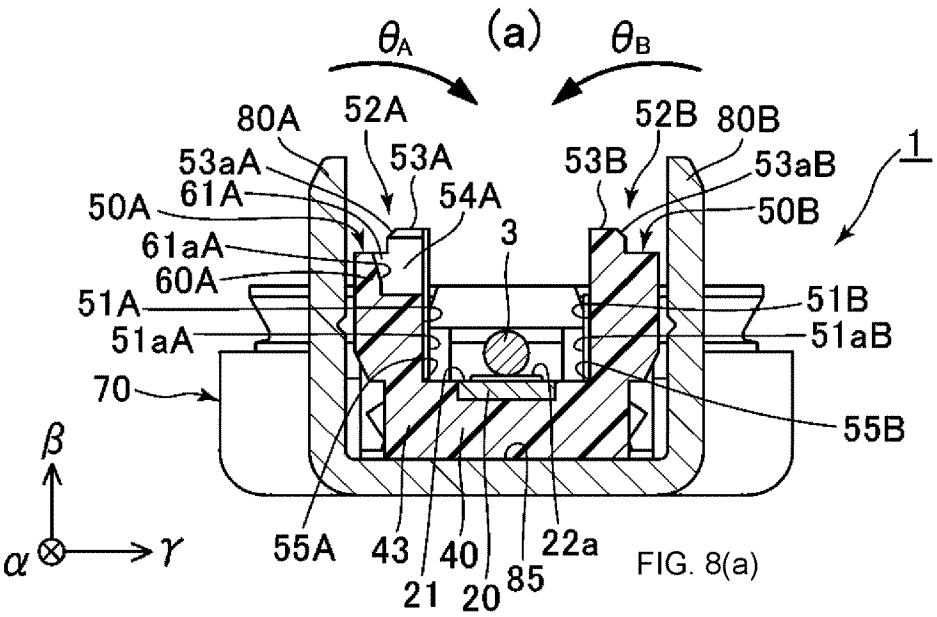
FIGS. 8 (*a*) to 8 (*d*) A view illustrating the pivoting of the pair of crimping pieces in a step-by-step manner.
Figure 8B:
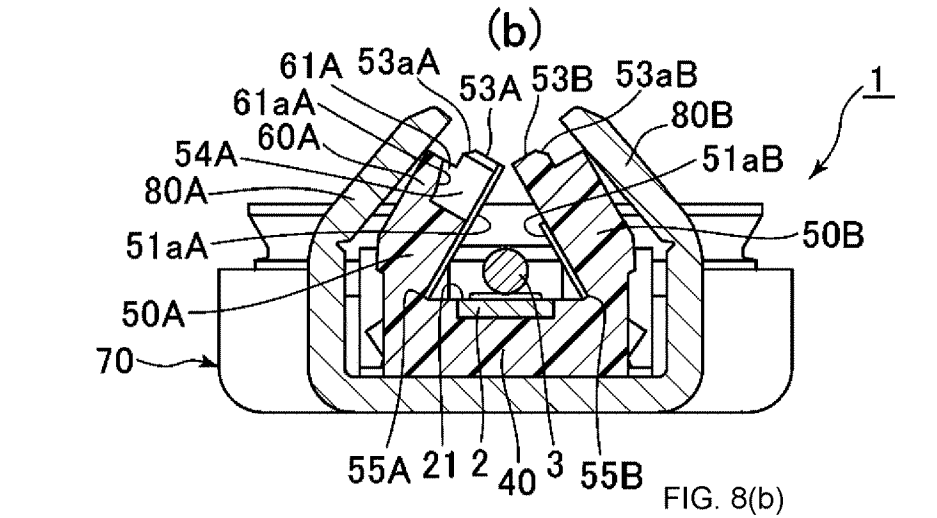
Figure 8C:
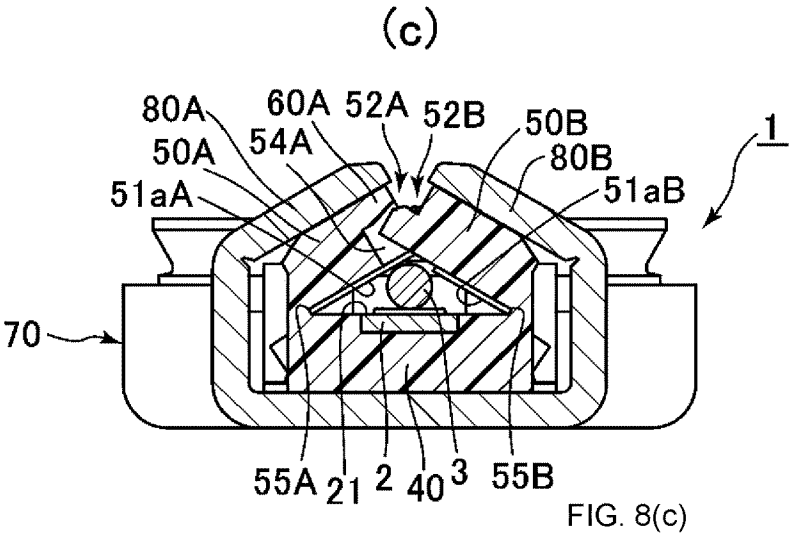
Figure 8D:
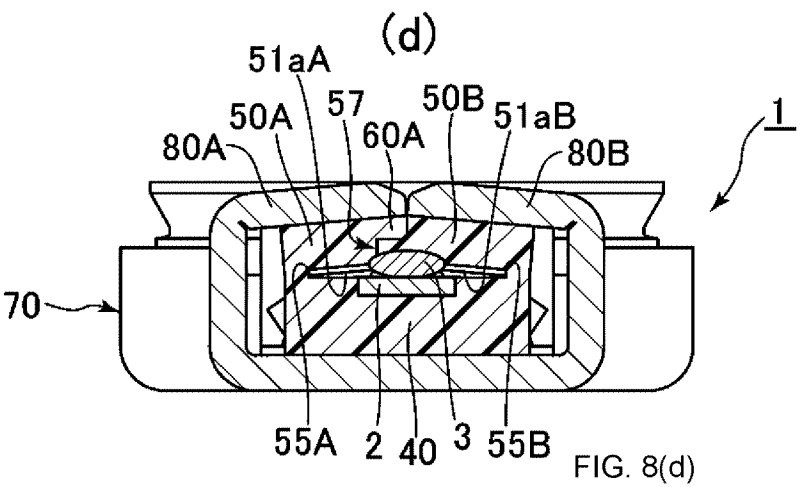
Figure 9A:
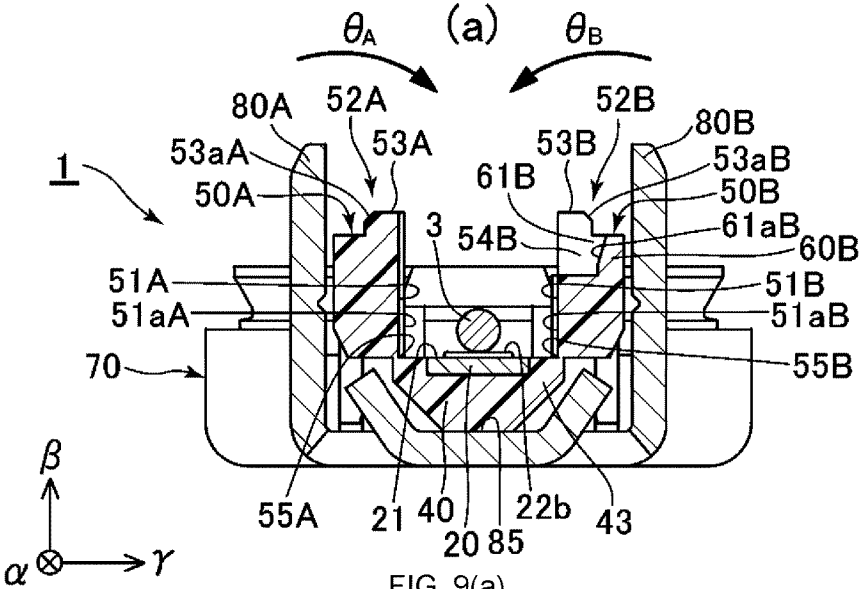
FIGS. 9 (*a*) to 9 (*d*) A view illustrating the pivoting of the pair of crimping pieces in a step-by-step manner.
Figure 9B:
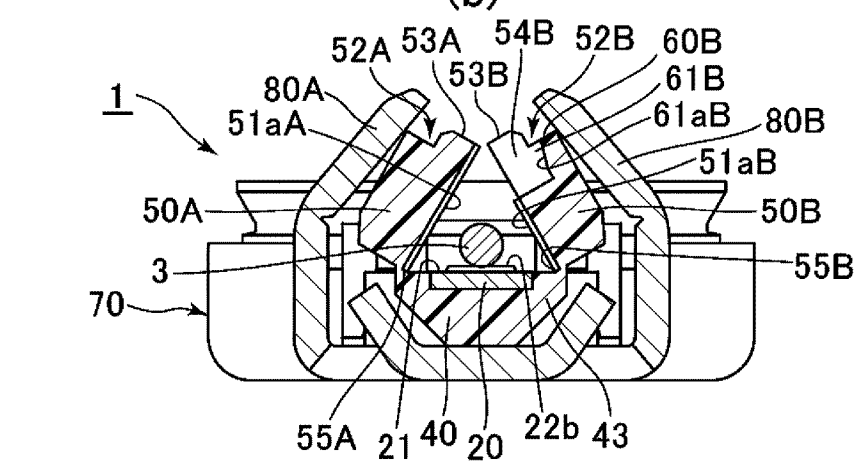
Figure 9C:
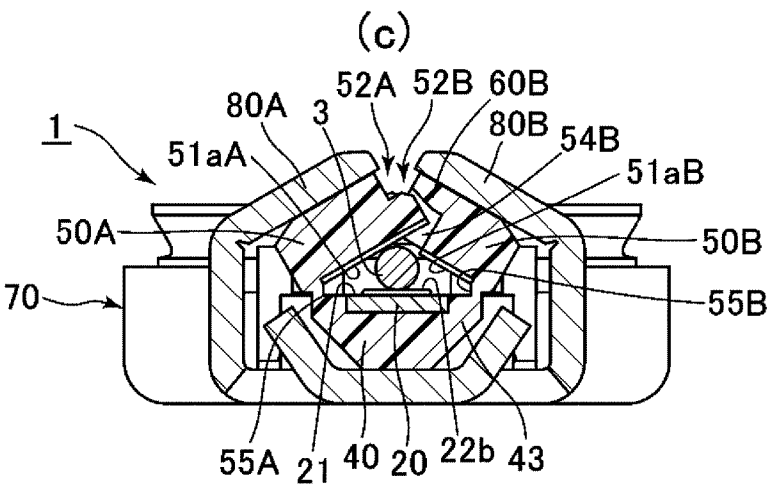
Figure 9D:
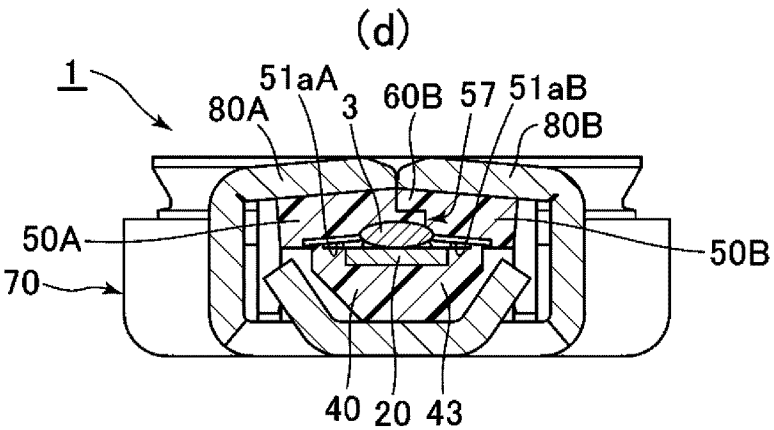

The protruding portions 51*a*A, 51*a*B of the opposed faces 51A, 51B and the protruding portions 22*a*, 22*b* of the mounting surface 21 may be provided offset in an alternating manner in the direction "α" of the fold lines 55A, 55B. FIG. 7 illustrates a cross-section obtained when the protruding portions provided in an alternating manner are engaged. This drawing is a partial enlarged view of FIG. 4 which, in particular, shows a state in which the core wire 3 of the coaxial cable is crimped between the opposed face 51A (51B) and the mounting surface 21 as a result of pivoting the pair of crimping pieces 50A, 50B and positioning these opposed faces 51A, 51B opposite the mounting surface 21. Since at such time the core wire 3 is sandwiched between the protruding portions 51*a*A (51*a*B) of the opposed face 51A (51B) and the protruding portions 22*a*, 22*b* of the mounting surface 21 in an undulating manner, the core wire 3 is rigidly secured in place, in particular, in the axial direction "α" of the coaxial cable.

Recessed portions 54A, 54B, which engage with the convex portions 53A, 53B provided on the abutting faces 52B, 52A of the counterpart crimping pieces 50B, 50A when the pair of crimping pieces 50A, 50B are pivoted, are provided on at least one of the abutting faces 52A, 52B of the pair of crimping pieces 50A, 50B.

In the illustrated example, a total of 3 portions, i.e., a convex portion 53A, a recessed portion 54A, and a convex portion 53A are provided in an alternating manner in the direction "α" of the fold lines 55A, 55B on abutting face 52A, while a recessed portion 54B, a convex portion 53B, and a recessed portion 54B are correspondingly provided on abutting face 52B in a similar manner. There are no specific restrictions regarding the number of such recessed and convex portions, such that only one recessed or convex portion, or a plurality of recessed and convex portions may be provided on each of the abutting faces 52A, 52B.

Covering portions 60A, 60B are respectively provided on the sides of the recessed portions 54A, 54B opposite to the opposed faces 51A, 51B. When the pair of crimping pieces 50A, 50B are pivoted and the recessed portions 54A, 54B are engaged with the convex portions 53A, 53B, these covering portions 60A, 60B cover the engagement portion of the recessed and convex portions. Providing these covering portions 60A, 60B makes it possible to prevent ingress of dust and the like through gaps that may appear along the engagement portion and, as a result, makes it possible to increase the contact reliability of the connector. While the covering portions 60A, 60B can offer excellent advantages, there is a risk that the convex portions 53A, 53B may collide with the covering portions 60A, 60B, respectively, when the convex and recessed portions are engaged by pivoting the crimping pieces 50A, 50B. Relief spaces 61A, 61B (see FIGS. 5, 6) are provided in each covering portion 60A, 60B in order to prevent such a collision.

The function of the relief spaces 61A, 61B will now be described with reference to FIG. 8 and FIG. 9. FIG. 8, in the same manner as FIG. 5, is a drawing depicting cross-sectional views taken along line A-A in FIG. 2, and FIG. 9, in the same manner as FIG. 6, is a drawing depicting cross-sectional views taken along line B-B in FIG. 2, with both drawings illustrating the pivoting of the pair of crimping pieces 50A, 50B in a step-by-step manner.

When the crimping pieces 50A, 50B are pivoted, the first step is the installation of the coaxial cable. The core wire of the coaxial cable 3 is mounted to the mounting surface 21 of the terminal 20. The mounting surface 21 is positioned at a location corresponding to the enclosing pieces 80A, 80B of the outer conductor shell 70 in the axial direction "α" of the coaxial cable.

The enclosing pieces 80A, 80B of the outer conductor shell 70 are then pivoted in the directions "$\theta_A$" and "$\theta_B$" at the corresponding locations. As a result, the crimping piece 50A is pivoted about the fold line 55A and the crimping piece 50B is pivoted about the fold line 55B toward the mounting surface 21 through contact with the enclosing pieces 80A, 80B.

At such time, as can be seen from FIGS. 8 (*a*) and 8 (*b*), the opposed face 51A of the crimping piece 50A and the opposed face 51B of the crimping piece 50B are moved to the side facing the mounting surface 21 to form a plane. In addition, the abutting face 52A of the crimping piece 50A and the abutting face 52B of the crimping piece 50B are moved in the direction of mutual abutment, in other words, the recessed portion 54A of the abutting face 52A and the convex portion 53B of the abutting face 52B are moved toward each other. Subsequently, as shown in FIG. 8 (*c*), the opposed face 51A of the crimping piece 50A, in particular, the protruding portion 51*a*A provided on the opposed face 51A, and the opposed face 51B of the crimping piece 50B, in particular, the protruding portion 51*a*B provided on the opposed face 51B, reach the core wire 3 of the coaxial cable and, in addition, a portion of the convex portion 53B of the abutting face 52B enters the recessed portion 54A of the abutting face 52A. As shown in FIG. 8 (*d*), as a result of further pivoting, the core wire 3 is secured in a crushed state by the protruding portion 51*a*A of the crimping piece 50A and the protruding portion 51*a*B of the crimping piece 50B, and, in addition, the convex portion 53B of the abutting face 52B becomes engaged with the recessed portion 54A of the abutting face 52A, thereby forming an engagement portion 57. Simultaneously with the engagement of the convex portion 53B with the recessed portion 54A, this engagement portion 57 is covered by the covering portion 60A of the recessed portion 54A provided on the side opposite to the opposed face 51A. Therefore, the ingress of dust and the like can be efficiently prevented. Although the covering portion 60A offers superior functionality, for example, in the state illustrated in FIG. 8 (*c*), there is a risk that the covering portion 60A may collide with the convex portion 53B. Providing the covering portion 60A with relief space 61A makes it possible to mitigate such risk. Furthermore, providing a taper 53*a*B by chamfering the corner of the distal end of the convex portion 53B makes it possible to efficiently prevent collision with the covering portion 60A.

While FIGS. 8 (*a*) to 8(*d*) describe the function of relief space 61A in a case in which a recessed portion is formed in the crimping piece 50A and, in addition, a convex portion is formed in the crimping piece 50B, by contrast, FIGS. 9 (*a*) to 9 (*d*) describes the function of relief space 61B in a case in which a convex portion is formed in the crimping piece 50A and, in addition, a recessed portion is formed in the crimping piece 50B. As can be seen from the descriptions below, the function of relief space 61B is identical to the function of the relief space 61A.

As can be seen from FIGS. 9 (*a*) and (*b*), the crimping piece 50A is pivoted through contact with the enclosing piece 80A about the fold line 55A, and, in addition, the crimping piece 50B is pivoted through contact with the enclosing piece 80B about the fold line 55B, i.e., the crimping pieces are pivoted toward each other in the directions "$\theta_A$" and "$\theta_B$". At such time, the opposed face 51A of the crimping piece 50A and the opposed face 51B of the crimping piece 50B are moved to the side facing the mounting surface 21 to form a plane. In addition, the abutting face 52A of the crimping piece 50A and the abutting face 52B of the crimping piece 50B are moved in the direction of mutual abutment, in other words, the recessed portion 54B of the abutting face 52B and the convex portion 53A of the abutting face 52A are moved toward each other. Subsequently, as shown in FIG. 9 (*c*), the opposed face 51A of the crimping piece 50A, in particular, the protruding portion 51*a*A provided on the opposed face 51A, and the opposed face 51B of the crimping piece 50B, in particular, the protruding portion 51*a*B provided on the opposed face 51B, reach the core wire 3 of the coaxial cable and, in addition, a portion of the convex portion 53A of the abutting face 52A enters the recessed portion 54B of the abutting face 52B. As shown in FIG. 9 (*d*), as a result of further pivoting, the core wire 3 is secured in a crushed state by the protruding portion 51*a*A of the crimping piece 50A and the protruding portion 51*a*B of the crimping piece 50B, and, in addition, the convex portion 53A of the abutting face 52A becomes engaged with the recessed portion 54B of the abutting face 52B, thereby forming an engagement portion 57. Simultaneously with the engagement of the convex portion 53A with the recessed portion 54B, this engagement portion 57 is covered by the covering portion 60B of the recessed portion 54B provided on the side opposite to the opposed face 51B. Although the covering portion 60B offers superior functionality, for example, in the state illustrated in FIG. 9 (*c*), there is a risk that the covering portion 60B may collide with the convex portion 53B. Therefore, providing relief space 61B makes it possible to mitigate such risk. In addition, in order to prevent collision with the covering portion 60B in an efficient manner, a taper 53*a*A is provided in the corner of the distal end of the convex portion 53A.

Figure 10:
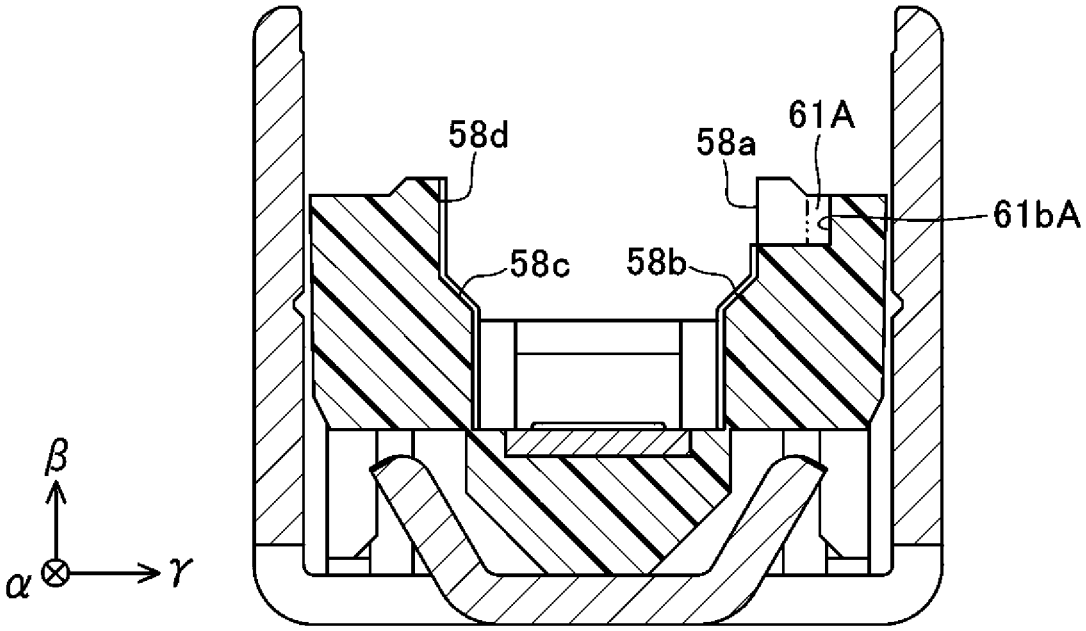
FIG. 10 A diagram illustrating a variation of the present invention.

It should be noted that, when viewed in the direction "α" of the fold lines 55A, 55B, the relief spaces 61A, 61B illustrated in FIGS. 8 and 9 are formed as tapered surfaces 61*a*A (61*a*B) that extend from the abutting faces in the covering portions 60A, 60B to the abutting faces in the recessed portions 54A, 54B. However, as illustrated in the variation of FIG. 10, the relief space (61A) may be formed as a stepped surface 61*b*A. In such a case, the stepped surface is not limited to a single step and may include multiple steps.

Furthermore, as shown in FIG. 10, the opposed faces may form surfaces 58*a-d* at locations spaced apart from the mounting surface when the opposed faces are positioned opposite the mounting surface. This configuration makes it possible to reliably secure the core wire in a reliable manner and without damaging the connector even if the diameter of the core wire of the coaxial cable is large.

Quite naturally, the present invention is not limited to the above-described embodiments and allows for a variety of modifications. Therefore, numerous variations that are within the capabilities of a person skilled in the art are included within the scope of the inventive claims.

INDUSTRIAL APPLICABILITY

The invention is applicable not only to coaxial connectors, but also more broadly to cable connectors provided with a housing having a pair of crimping pieces including recessed and convex portions on faces abutting counterpart crimping pieces.

DESCRIPTION OF THE REFERENCE NUMERALS

1 Coaxial cable connector
20 Terminal
21 Mounting surface
24 Connecting portion
25 Contact portion
40 Housing
50A, 50B Crimping pieces
51A, 51B Opposed faces
52A, 52B Abutting faces
55A, 55B Fold lines
57 Engagement portion
60A, 60B Covering portions
61A, 61B Relief spaces
70 Outer conductor shell
80A, 80B Enclosing pieces

The invention claimed is:

1. A coaxial cable connector, wherein said connector comprises a terminal and a housing supporting the terminal;

a portion of the terminal is exposed through the housing to form a mounting surface;

the housing has a pair of crimping pieces provided on opposite sides sandwiching the mounting surface so as to permit pivoting toward the mounting surface about fold lines;

the pair of crimping pieces include, respectively, opposed faces that are positioned opposite the mounting surface when the pair of crimping pieces are pivoted, and abutting faces brought into abutment against a counterpart crimping piece;

at least one of the abutting faces of the pair of crimping pieces is provided with a recessed portion that engages with a convex portion provided on the abutting face of the counterpart crimping piece when the pair of crimping pieces are pivoted;

a covering portion that covers the engagement portion of the recessed and convex portions is provided on the side of the recessed portion opposite to the opposed faces, the covering portion positioned to cover the recessed and convex portions of the abutting faces from above upon folding of the pair of crimping pieces; and the covering portion is provided with a relief space that prevents collision with the convex portion when the pair of crimping pieces are pivoted and the recessed portion engages with the convex portion.

2. The coaxial cable connector according to claim 1, wherein the relief space, when viewed in the direction of the fold lines, is formed as a tapered surface that extends from the abutting face in the covering portion to the abutting face in the recessed portion.

3. The coaxial cable connector according to claim 1, wherein the relief space, when viewed in the direction of the fold lines, is formed as a stepped surface that extends from the abutting face in the covering portion to the abutting face in the recessed portion.

4. The coaxial cable connector according to claim 1, wherein the opposed faces form surfaces at locations spaced apart from the mounting surface when the opposed faces are positioned opposite the mounting surface.

5. The coaxial cable connector according to claim 1, wherein at least a total of 3 convex and recessed portions are arranged on the respective abutting faces of the pair of crimping pieces in an alternating manner in the direction of the fold lines.

6. The coaxial cable connector according to claim 1, wherein protruding portions protruding toward the mounting surface are provided on the opposed faces in a direction intersecting with the fold lines.

7. The coaxial cable connector according to claim 6, wherein protruding portions protruding toward the opposed faces are provided on the mounting surface in a direction intersecting with the fold lines.

8. The coaxial cable connector according to claim 7, wherein the protruding portions of the opposed faces and the protruding portions of the mounting surface are provided in an alternating manner in the direction of the fold lines.

* * * * *